US005565754A

United States Patent [19]

Pietrzak

[11] Patent Number: 5,565,754

[45] Date of Patent: Oct. 15, 1996

[54] COLOUR FIELD EMISSION DISPLAY

[75] Inventor: Christopher C. Pietrzak, Winchester, England

[73] Assignee: International Business Machines Corporation, Armonk, N.Y.

[21] Appl. No.: 524,196

[22] Filed: Sep. 6, 1995

Related U.S. Application Data

[63] Continuation of Ser. No. 86,253, Jun. 30, 1993, abandoned.

[30] Foreign Application Priority Data

Jun. 30, 1992 [GB] United Kingdom ..... 9213912

[51] Int. Cl.[6] ..... H01J 1/62; H01J 63/04

[52] U.S. Cl. ..... 313/496; 313/461

[58] Field of Search ..... 313/495, 496, 313/497, 309, 336, 351, 442; 315/169.4; 345/88, 83, 74, 75, 72, 77, 76, 150, 152

[56] References Cited

U.S. PATENT DOCUMENTS

| | | | |
|---|---|---|---|
| 3,665,241 | 5/1972 | Spindt et al. | 313/351 |
| 3,755,704 | 8/1973 | Spindt et al. | 313/309 |
| 3,789,471 | 2/1974 | Spindt et al. | 29/25.17 |
| 4,857,799 | 8/1989 | Spindt et al. | 313/495 |
| 5,015,912 | 5/1991 | Spindt et al. | 313/497 |
| 5,210,462 | 5/1993 | Konishi | 313/495 |
| 5,216,324 | 6/1993 | Curtin | 313/495 |
| 5,223,766 | 6/1993 | Nakayama et al. | 313/495 |

FOREIGN PATENT DOCUMENTS

| | | | |
|---|---|---|---|
| 2247963 | 3/1990 | Japan | H01J 31/15 |
| WO8801098 | 2/1988 | WIPO | H01J 31/12 |

*Primary Examiner*—Edward L. Coles, Sr.
*Assistant Examiner*—Jerome Grant, II
*Attorney, Agent, or Firm*—David Aker; Daniel P. Morris

[57] ABSTRACT

A field emission display comprises a screen (10) divided into a plurality of pixels. Each pixel has a plurality of subpixels (130,140,150) of different phosphor efficacies. A matrix of field emission cathodes (80) is directed towards corresponding pixels of the screen (10). Each cathode has a plurality of arrays (81,82,83) of field emissive tips directed towards corresponding subpixels (130,140,150). The arrays of each cathode (80) comprise different numbers of field emission tips to reduce the effect of the difference in the phosphor efficacies of the corresponding subpixels (130,140,150). This advantageously permits tracking between the primary colour components of a gray scale displayed image to be maintained used the same algorithm to translate into voltages for driving the arrays. Therefore, the Colour Point or White Point of the display can be maintained between extremes of gray scale using the same algorithm. Because the separate algorithms are not required for translating the video signals into gate voltages, the row driver circuitry can be greatly simplified.

3 Claims, 3 Drawing Sheets

COLOUR FIELD EMISSION DISPLAY

This is a continuation of application Ser. No. 08/086,253 filed Jun. 30, 1993, now abandoned.

TECHNICAL FIELD

The present invention relates to a colour field emission display in which the distribution of emissive tips is determined as a function of subpixel phosphor efficacy.

BACKGROUND ART

U.S. Pat. No. 4,857,799 describes an example of conventional colour field emission display. Such displays typically comprise a cathodoluminescent screen overlying and spaced from a two dimensional matrix of field emission cathodes. U.S. Pat. Nos. 3,789,471, 3,665,241, and 3,775,704 describe examples of, and methods of producing such cathodes. Each cathode comprises three arrays of field emissive tips. The arrays each comprise substantially the same number of tips (typically 1000). The screen is divided into a plurality of pixels. Each pixel is divided into three subpixels. Each subpixel is formed by a phosphor corresponding to a different one of the three primary colours, Red, Green and Blue. Each array of a cathode faces a different subpixel of a corresponding pixel. The arrays are individual addressable via row and column conductors.

In operation, voltages determined by red, green and blue input video signals are sequentially applied to the row and column conductors to address each cathode in turn in a raster fashion. The voltages interact to generate a localised high electric field at each tip. The localised electric fields drag electrons from the tips. The electrons are collectively accelerated towards the phosphors by an electric field generated between the screen and the cathode matrix. The phosphors are excited by incident electrons to display an image as a function of the input video signals.

The three phosphors corresponding to each cathode in general have different Quantum Yields or Efficacies (typically 1.5 lm/w for red, 0.5 lm/w for green, and 4.0 lm/w for blue). Conventionally, therefore, the video signals each translated by separate algorithms into the voltages addressed to the arrays to maintain tracking between the primary colour components of a gray scale displayed image. In other words, the separate algorithms maintain the "Colour point" or "White point" of the image between extremes of the gray scale. This requirement leads to complex drive circuitry for addressing the voltages to the row and column conductors.

SUMMARY OF THE INVENTION

In accordance with the present invention, there is now provided a field emission display comprising: a screen divided into a plurality of pixels each having a plurality of subpixels of different phosphor efficacies; and a matrix of field emission cathodes directed towards corresponding pixels of the screen and each cathode having a plurality of arrays of field emissive tips directed towards corresponding subpixels; characterised in that the arrays of each cathode comprise different numbers of field emissive tips to reduce the effect of the difference in the phosphor efficacies of the corresponding subpixels.

The present invention stems from a realisation that the different efficacies of the phosphors can be compensated by allocating different numbers of tips to the arrays, with the arrays having higher numbers of tips directed towards the subpixels of lower phosphor efficacies, and the arrays having lower numbers of tips being directed towards the subpixels of higher phosphor efficacies.

This advantageously permits tracking between the primary colour components of a gray scale displayed image to be maintained used the same algorithm to translate into voltages for driving the arrays. Therefore, the Colour Point or White Point of the display can be maintained between extremes of gray scale using the same algorithm. Because the separate algorithms are not required for translating the video signals into gate voltages, the row driver circuitry can be greatly simplified.

In a preferred embodiment of the present invention, each cathode comprises three arrays respectively directed towards red, green and blue subpixels, the array with the highest number of tips being directed towards the Green phosphor because it has the lowest efficacy, the array with the lowest number of tips being directed towards the Blue phosphor with the highest efficacy, and the array with the intermediate number of tips being directed towards the red phosphor with the intermediate efficacy.

A preferred example of the present invention will now be described, by way of example only, with reference to the accompanying drawings in which:

DETAILED DESCRIPTION OF THE PREFERRED EMBODIMENTS

Figure 1:
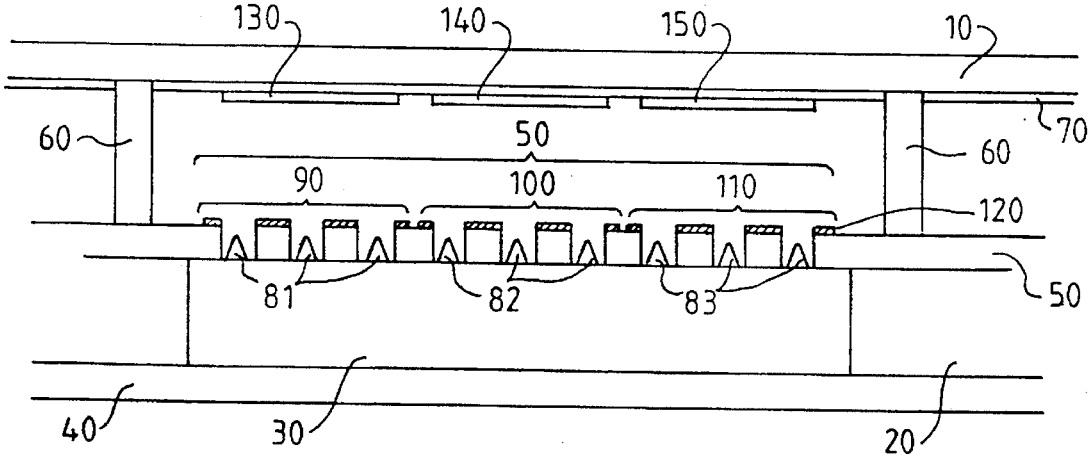
FIG. 1 is cross sectional view of a field emission display of the present invention.

Referring first to FIG. 1, a colour field emission display of the present invention comprises a transparent screen 10 superimposed and spaced from a non conductive back plate 20 of Silicon Dioxide for example. The surface of the screen 10 facing the back plate 20 carries a transparent conductive layer 70 of Indium Tin Oxide for example. A matrix of cathodes 80 is provided on the surface of the back plate 20 facing the face plate 10. Each cathode 80 comprises three arrays 81,82,83 of field emitter tips 81,82,83 of Molybdenum for example. The arrays each occupy substantially equal areas. Each array corresponds to different one of the three primary colours, Red, Green, and Blue. The tips are about 1.4 um in diameter at a spacing of around 5 um. The area of each array is typically 1250 square um.

The arrays 81,82,83 are provided with a conductive base 30 of Amorphour Silicon for example extending through the back plate 20. The bases 30 of the cathodes in each column of the matrix are interconnected by a conductive strip or column conductor 40 of Niobium for example. The tips project towards the face plate 10 from pits formed in an insulator layer 50 of Silicon Dioxide for example. A conductive gate layer 120, of Niobium for example, is carried on the surface of the insulator layer 50 facing the face plate 10. The gate layer is divided to form three gates per cathode 80, one for each of the arrays 81,82,83. The gates of the arrays 81,82,83 along each row of the matrix array are interconnected to form conductive strips or row conductors 90,100, 110. Each array 81,82,83 of each cathode 80 of the display therefore can be addressed by orthogonal address lines in the form of the column conductor 40 connected to the base 30 of the cathode 80 and the row conductor 90,100,110 perforated by the pits in which the tips of the array 81,82,83 are located.

Phosphor strips 130,140,150 corresponding to the three primary colours R, G and B are provided on the conductive layer 70. Each one of the strips 130,140,150 faces a different one of the arrays 81,82,83. The space between the screen 10 and the back plate 20 is evacuated. Therefore, spacers 60 are provided between screen 10 and the back plate 20 to prevent distortion of the space. The spacers 60 maintain a distance of typically 200 um between the back plate 20 and the screen 10.

The back plate 20, conductor 40, 120 and insulator layer 50 can be fabricated by conventional photolithography in combination with conventional processes such as planar diffusion, electrochemical etching, chemical vapour deposition or the like. The pits in which the tips are located can be ion etched into the insulator layer 50. The tips themselves can be fabricated by a combination of Electron Beam Evaporation and electrochemical etching. To mechanically strengthen the display, the backplate 20 may be fabricated on a glass substrate.

Figure 2:
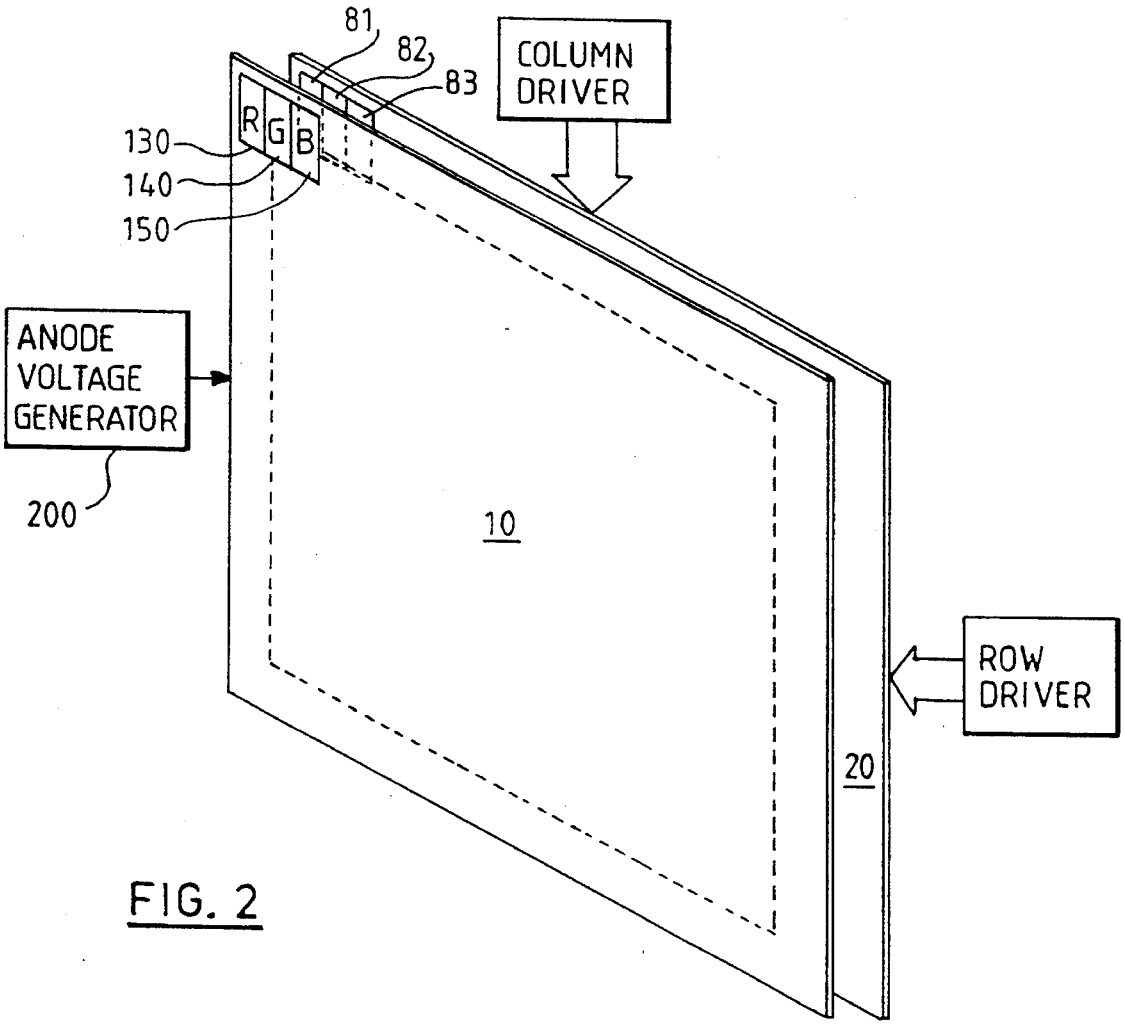
FIG. 2 is a block diagram of a field emission display of a field emission display of the present invention.

Referring now to FIG. 2, the conductive coating 70 is connected to an anode voltage generator 200, the column conductors are connected to a column driver 210, and the row conductors are connected to a row driver 220. In operation, the anode voltage generator 200 applies an anode voltage of around 400 V to the conductive layer 70 hereinafter referred to as the anode 70. The column driver 210 applies a drive voltage of around –30 V to the row conductors 90,100,110. The drive voltage is transmitted to the tips in the arrays 81,82,83 via the bases 30. The row driver 220 applies a bias voltage of typically 50 V to the row conductors 90,100,110 forming the gates. The voltages on the row and column conductors cooperate in generating localised high electric fields to drag electrons form each tip. The electrons are collectively accelerated towards the phosphors 130,140, 150 by the high electric fields produced at the anode 70. Each tip emits electrons in typically a thirty degree cone diverging towards the phosphors 130,140,150. The total electron beam current from an array comprising, for example, 1000 tips is around 100 uA. The phosphors 130, 140,150 are excited by the incident electrons to generate the displayed image. Each cathode 80 corresponds a pixel of the displayed image. Each array of the cathode corresponds to one of the Red, Green and Blue subpixels of each pixel of the displayed image.

The row and column conductors are typically scanned by the drivers 210,220 to sequentially address drive and bias voltages to the arrays 81,82,83 of each cathode 80 in a raster fashion. The drivers 210,220 can be conventional liquid crystal display or plasma panel address drivers for example. The drive voltage on each cathode is maintained constant but the three gate voltages per cathode are varied as functions of Red, Green and Blue video signals respectively to produce the displayed image.

The Quantum Yield or Efficacy of the phosphors varies with colour. Typically, the Red, Green and Blue phosphors have Efficacies of 1.5, 0.5, and 4.0 lm/w respectively.

Figure 3:
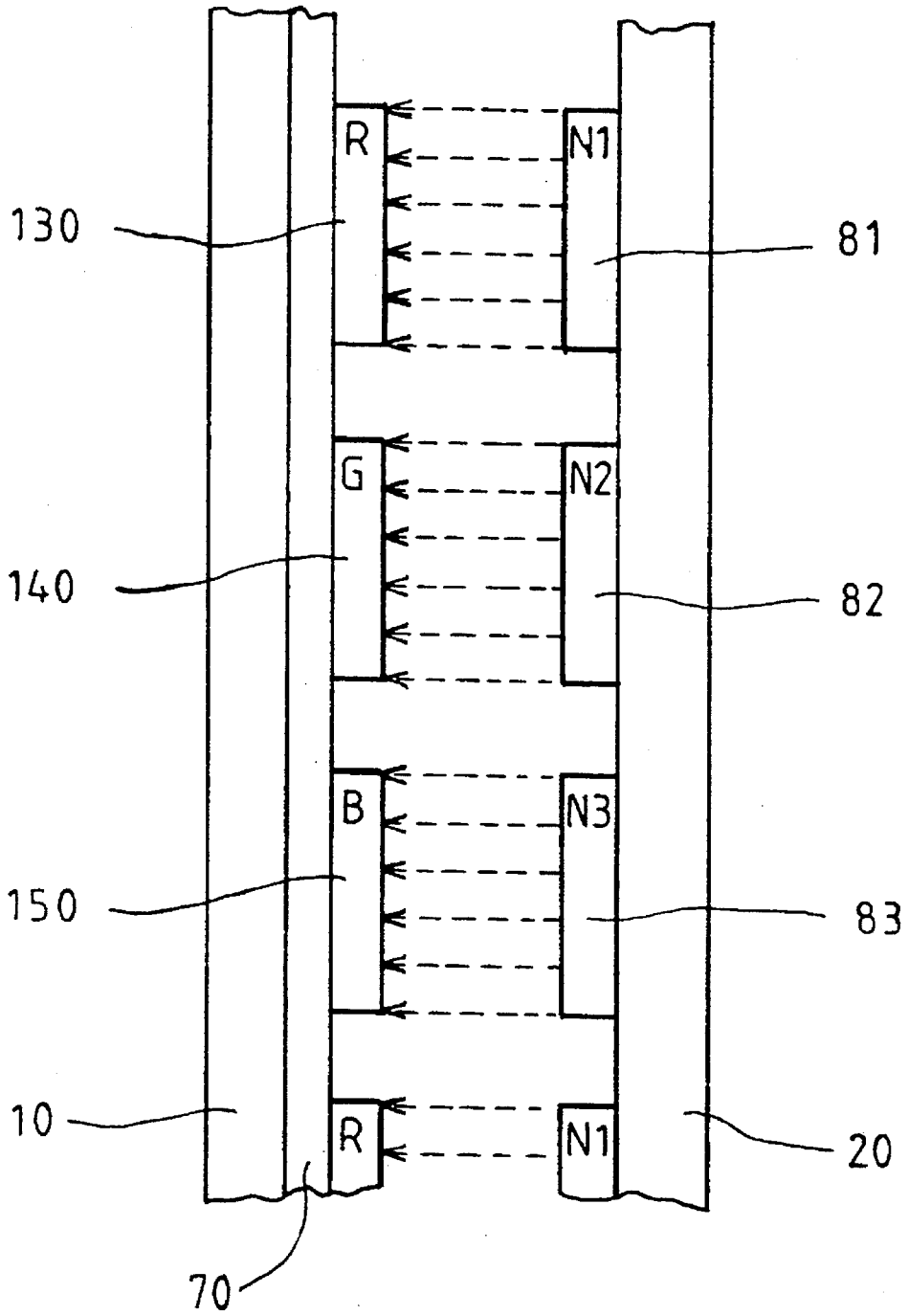
FIG. 3 is a side view of a pixel of a field emission display of the present invention.
Figure 4:
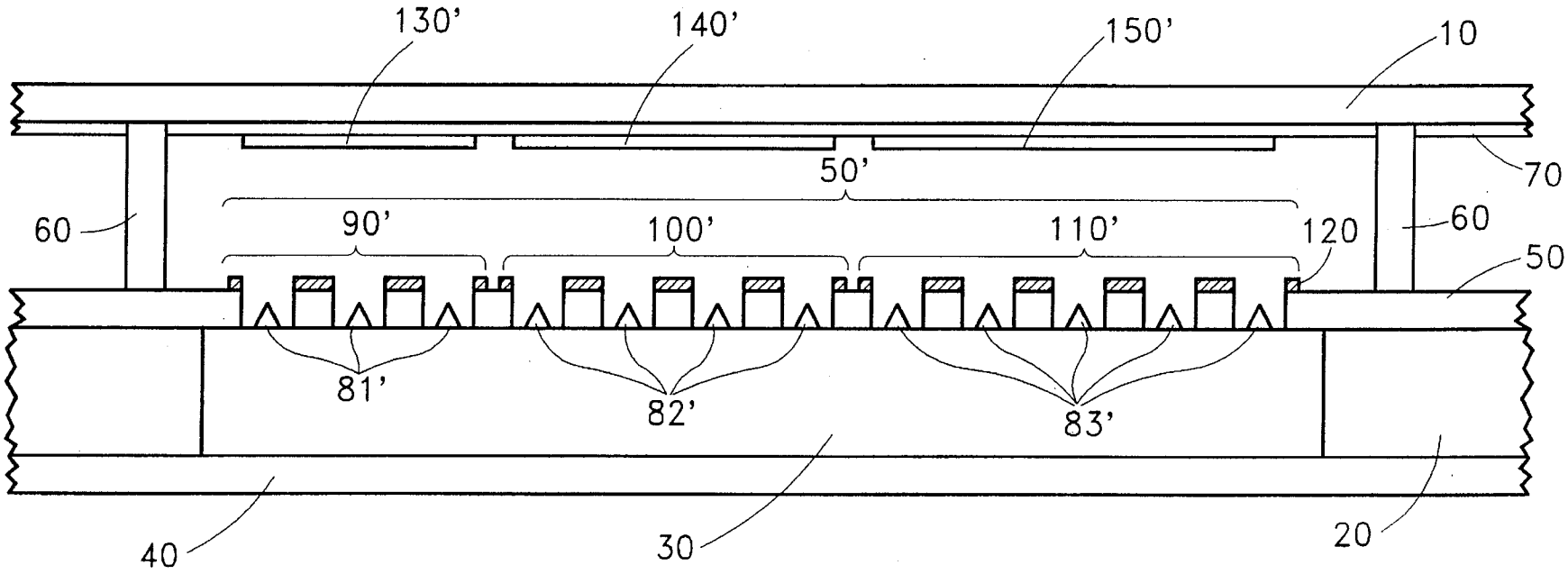
FIG. 4 shows another cross sectional view of the field emission display showing the arrays of each cathode comprising different numbers of densities of field emissive tips with the higher number of density of tips directed towards the subpixels of lower phosphor efficacies and the lower number or density of tips directed towards the subpixels of higher phosphor efficacies.

Referring to FIG. 3, in accordance with the present invention, the densities N1, N2, N3 of the tips in the three arrays of each cathode are set to compensate for the different efficacies of the phosphors. Specifically, the array with the highest number of tips N2 is directed towards the Green phosphor because it has the lowest efficacy. Correspondingly, the array with the lowest number of tips is directed towards the Blue phosphor with the highest efficacy. The array with the intermediate number of tips is directed towards the red phosphor with the intermediate efficacy. Because the different efficacies of the phosphors are compensated by the different numbers of tips in the arrays, tracking between the primary colour components of a gray scale displayed image can be maintained used the same algorithm to translate red, green and blue video signals into the gate voltages addressed to the arrays. Therefore, the Colour Point or White Point of the display can be maintained between extremes of gray scale using the same algorithm. Because the separate algorithms are not required for translating the video signals into gate voltages, the row driver circuitry can be greatly simplified.

The numbers of tips in the arrays are determined during the photolithography stage of the fabrication process by apertures in a photomask. Therefore, the colour point of a display of the present invention can conveniently be determined during the photolithography stage. Consequently, once the mask has been designed, back plates for displays of the present invention can be manufactured at no more than the cost per unit of conventional field emission displays.

In the preferred embodiment of the present invention hereinbefore described, each cathode 80 comprises a single base 30 and three separate gates 81,82,83 for receiving gate voltages modulated by red, green and blue video signals respectively. It will however be appreciated that the present invention is equally applicable to field emission displays in which each cathode 80 has a single gate and three independent bases for receiving base voltages modulated by red, green and blue video signals. Furthermore, it will be appreciated that the present invention is equally applicable to field emission displays of the switched anode type in which the anode 70 is divided into three individually addressable sections corresponding to the three subpixels of each pixel and the anode voltages applied to the three section are switched by the red, green, and blue video signals.

I claim:

1. A field emission display comprising: a screen divided into a plurality of pixels each having a plurality of subpixels of different phosphor efficacies; and a matrix of field emission cathodes directed towards corresponding pixels of the screen, each cathode having a plurality of arrays of field emissive tips directed towards corresponding subpixels; wherein the improvement comprises: the arrays of each cathode comprise different densities of field emissive tips to reduce effect of the difference in the phosphor efficacies of the corresponding subpixels, with the arrays having higher densities of tips directed towards the subpixels of lower phosphor efficacies, and the arrays having lower densities of tips directed towards the subpixels of higher phosphor efficacies.

2. A display as claimed in claim 1, wherein each cathode comprises a base conductor connected to the field emission tips of the cathode and a plurality of gate conductors each surrounding a different one of the arrays of field emission tips of the cathode.

3. A display as claimed in claim 1, wherein each cathode comprises a gate conductor surrounding the field emission tips of the cathode and a plurality of base conductors each connected to the field emission tips of a different one of the arrays of the cathode.

* * * * *